US006112625A

United States Patent [19]

Turtle

[11] Patent Number: 6,112,625

[45] Date of Patent: Sep. 5, 2000

[54] EXTENSION BAR FOR TOOL

[76] Inventor: Floyd Thomas Turtle, 531-M Cypress St., Fort Bragg, Calif. 95437-5465

[21] Appl. No.: 08/935,237

[22] Filed: Sep. 22, 1997

[51] Int. Cl.[7] ..... B25B 23/16

[52] U.S. Cl. ..... 81/177.2; 81/177.1

[58] Field of Search ..... 81/177.2, 177.85, 81/177.9, 124.5, 177.1

[56] References Cited

U.S. PATENT DOCUMENTS

| | | | |
|---|---|---|---|
| 1,456,290 | 5/1923 | Tell . | |
| 2,549,515 | 4/1951 | Orey et al. . | |
| 2,608,894 | 9/1952 | Miller, Jr. et al. . | |
| 2,680,985 | 6/1954 | Fish . | |
| 4,774,862 | 10/1988 | Scull . | |
| 4,840,094 | 6/1989 | Macor . | |
| 5,152,199 | 10/1992 | Lain . | |
| 5,279,189 | 1/1994 | Marino . | |
| 5,280,740 | 1/1994 | Ernst . | |
| 5,438,894 | 8/1995 | Pearce | 81/177.2 |
| 5,568,757 | 10/1996 | Lewis | 81/177.2 |
| 5,626,062 | 5/1997 | Colvin . | |

*Primary Examiner*—Timothy V. Eley
*Attorney, Agent, or Firm*—Fulwider Patton Lee & Utecht, LLP

[57] ABSTRACT

A wrench apparatus includes a wrench head with a swivel adapter, a combination handle and extension bar attachable to the swivel adapter, and a ratchet head. The wrench head includes a tubular member with a longitudinal slot, and an internal C-shaped brace dividing the tubular member into two sockets at opposite ends thereof. One socket includes six sides and five points, and the other socket includes twenty sides and ten points, so that both sockets can securely grip all six sides of a nut or bolt. The points of one socket are offset radially relative to the points of the other socket for providing smaller increments in repositioning freedom. The swivel adapter is pivotally attached between a pair of ears on the wrench head by a removable pin, so that it can be removed and attached between a like pair of ears on the ratchet head. The extension bar includes a female end with a faceted outer surface that prevents it from rolling on a slanted surface, and also enables the extension bar to be gripped and turned by a conventional wrench. In an alternative embodiment, the sockets include fully closed sides, and are divided by an annular brace therebetween.

1 Claim, 4 Drawing Sheets

EXTENSION BAR FOR TOOL

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to wrenches, such as socket, box, flare-nut, and open-end wrenches, and also ratchet wrenches.

2. Prior Art

A socket wrench set typically includes a handle with a ratchet head, and sockets of different sizes for interchangeably snapping onto the ratchet head. Each socket comprises a tubular member with internal facets for closely fitting over a nut or bolt, and a square hole in the opposite end for receiving a male connector on the ratchet head. Extension bars can be connected between the socket and the ratchet head for reaching deep into confined areas. An extension bar typically comprises a square tip at a male end for fitting into the square hole of a socket, and a square hole at a female end for receiving the male connector on a ratchet head or the male end of another extension bar. The outside surface of the female end is cylindrical, so that the extension bar tends to roll away easily when placed on a slanted surface, such as an uneven floor or the top of a vehicle.

Several inches of clearance from the end of a nut or bolt must be available for the socket to slip thereon. If not enough clearance is available, an open-end wrench may be used. A typical open-end wrench includes a handle with a pair of C-shaped wrench heads at the opposite ends. Each C-shaped wrench head includes a pair of parallel internal sides for gripping the opposite sides of a nut or bolt. The opening in the wrench head allows it to be slipped onto a nut or bolt in a direction perpendicular to the axis thereof. However, the long handle limits the rotation of the wrench in tight spaces. The wrench heads only grip two sides of a nut or bolt, so that they tend to slip out easily or even strip the nut or bolt. Further, many wrenches of different sizes must be provided, each with its own handle, so that a complete set of wrenches is very bulky, heavy, and costly. The many variations of such wrenches require a great deal of natural resources to produce.

A box wrench is similar to an open-end wrench, except that the wrench heads are closed circular loops. A typical box wrench head includes six facets and six points (outer corners between the facets) for securely gripping all six sides of a nut or bolt. It may be repositioned on a nut or bolt in 60 degree increments. Some box wrench heads include twenty-four facets and twelve points, so that the wrench may be repositioned on the nut or bolt in 30 degree increments when working in tight spaces. However, the long handles limit rotation, and wrenches must be provided in many different sizes, which may still be inadequate in some situations.

U.S. Pat. No. 5,626,062 to Colvin (1997) shows a ratchet wrench with a hole in the ratchet head for passing a stud. It includes a permanently attached handle which cannot be used with other tool heads. U.S. Pat. No. 5,280,740 to Ernst (1994) shows a ratchet head pivotally connected to a handle by a hinge pin. The pin is not removable, so that the handle cannot be used with other tool heads. U.S. Pat. No. 5,279,189 to Marino (1994) shows a box or socket wrench with a pivoting handle. It has all the limitations of the aforementioned box and socket wrenches. U.S. Pat. No. 5,152,199 to Lain (1992) shows a ratchet head for being turned by an adjustable jaw wrench. It includes no pivoting handle. U.S. Pat. No. 4,480,094 to Macor (1989) shows a socket wrench with a sliding insert for providing a total of four socket sizes. The sockets all have twelve points, and are radially aligned with each other, so that they are limited to 30 degree increments when being repositioned. U.S. Pat. No. 4,774,862 to Scull (1988) shows an open end wrench with up to nine points. It is limited to 30 degree increments when being repositioned, and its handle is fixed at an orthogonal position relative to the axis of the nut or bolt. Further, the wrench head may spread under load. U.S. Pat. No. 2,608,894 to Miller, Jr. et al. (1952) shows a simple open end wrench with a pivoting handle. U.S. Pat. No. 2,680,985 to Fish (1947) shows a ratchet wrench with five points, so that it is limited to 60 degree increments in repositioning. U.S. Pat. No. 2,549,515 to Orey et al. shows a socket wrench with a pivoting handle. U.S. Pat. No. 1,456,290 to Tell (1921) shows an adjustable wrench with only two points.

OBJECTS OF THE INVENTION

Accordingly an object of the present invention is to provide an improved wrench apparatus with a wrench head that securely grips all six sides of a nut or bolt.

Another object of the present invention is to provide a wrench apparatus with a wrench head with both five-point and ten-point sockets.

Another object of the present invention is to provide a wrench apparatus with an alternative wrench head with both six-point and twelve-point sockets.

Another object of the present invention is to provide a wrench apparatus with a wrench head that can be repositioned in finer increments for maximizing rotation in tight spaces.

Another object of the present invention is to provide a wrench apparatus with a wrench head with a C-shaped internal brace for strength.

Another object of the present invention is to provide a wrench apparatus with a handle which is interchangeable with different size wrench heads for reduced bulk, weight, and cost.

Another object of the present invention is to provide a wrench apparatus with a combination handle and extension bar.

Another object of the present invention is to provide a wrench apparatus with a handle or extension bar that tends to stay in position even when placed on a slanted surface.

Another object of the present invention is to provide a wrench apparatus with a swivel adapter for connecting the wrench heads to the handle, so that the handle can be rotated up to 90 degrees to either side of the wrench head, and enable the wrench head to be used as a speed wrench for rotating nuts or bolts quickly.

Yet another object of the present invention is to provide a wrench apparatus with a swivel adapter that can be interchangeably connected to different wrench heads and ratchet heads.

Further objects of the present invention will become apparent from a consideration of the drawings and ensuing description.

BRIEF SUMMARY OF THE INVENTION

A wrench apparatus includes a wrench head with a swivel adapter, a combination handle and extension bar attachable to a female end of the swivel adapter, and a ratchet head. The wrench head includes a tubular member with a longitudinal slot, and an internal C-shaped brace dividing the tubular member into two sockets at opposite ends thereof. One socket includes six sides and five points, and the other socket includes twenty sides and ten points, so that both sockets can securely grip all six sides of a nut or bolt. The swivel adapter is pivotally attached between a pair of ears on the wrench head by a removable pin, so that it can be removed and attached between a like pair of ears on the ratchet head. The extension bar includes a female end with a faceted outer surface that prevents it from rolling on a slanted surface.

Figure 1:
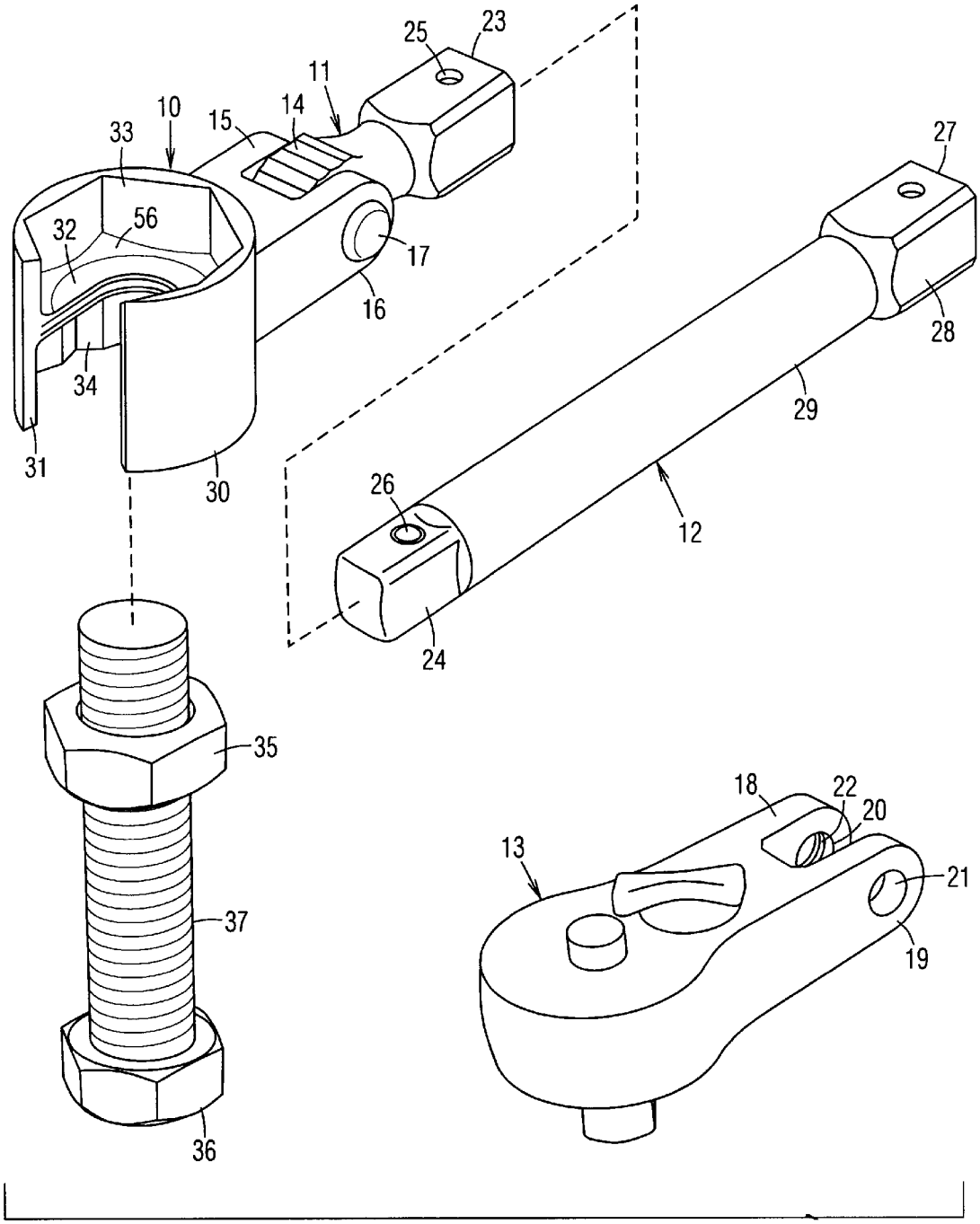
FIG. 1 is a side perspective view of a wrench apparatus in accordance with the invention.

| DRAWING REFERENCE NUMERALS | |
|---|---|
| 10. Wrench Head | 11. Swivel Adapter |
| 12. Combination Handle And Extension Bar | 13. Ratchet Head |
| 14. Semi-Circular End | 15. Ear |
| 16. Ear | 17. Pin |
| 18. Ear | 19. Ear |
| 20. Hole | 21. Hole |
| 22. Annular Detent | 23. Female End |
| 24. Male End | 25. Hole |
| 26. Spring-Loaded Ball | 27. Female End |
| 28. Flat Sides | 29. Shaft |
| 30. Tubular Member | 31. Slot |
| 32. C-Shaped Brace | 33. Socket |
| 34. Socket | 35. Nut |
| 36. Bolt | 37. Shaft |
| 38. Hole | 39. Hole |
| 40. Hole | 41. Ball |
| 42. Spring | 43. Annular Detent |
| 44. Tapered Outer End | 45. Bolt |
| 46. Surface | 47. Ribs |
| 48. Ball | 49. Shank |
| 50. Spring | 51. Detents |
| 52. Wrench Head | 53. Socket |
| 54. Socket | 55. Annular Brace |
| 56. Fillet | |

DETAILED DESCRIPTION OF THE INVENTION

FIG. 1

In accordance with a preferred embodiment of the invention shown in the side perspective view of FIG. 1, a wrench apparatus includes a wrench head 10, a swivel adapter 11, a combination handle and extension bar 12, and a ratchet head 13. Swivel adapter 11 includes a semi-circular end 14 positioned between a pair of ears 15 and 16 extending from wrench head 10. Semi-circular end 14 is rotatably connected to ears 15 and 16 by a removable hinge pin 17. Swivel adapter 11 can be detached from wrench head 10 and attached to ratchet head 13, which includes a pair of ears 18 and 19 with holes 20 and 21, respectively, for receiving pin 17. An annular detent 22 is arranged in hole 20; a similar annular detent (FIG. 3) is arranged in a corresponding hole (FIG. 3) of ear 15 of wrench head 10. Ratchet head 13 includes a conventional ratchet mechanism for attaching to and turning conventional sockets.

Swivel adapter 11 includes a female end 23 with a square hole (not shown) for receiving a square male end 24 of extension bar 12. A detent hole 25 is arranged on a side of female end 23 for engaging a spring-loaded locking ball 26 on male end 24.

Extension bar 12 includes a female end 27 with a square hole (not shown) for receiving the square male end of any other extension bar (not shown), so that any number of extension bars can be connected together for increased reach or leverage. Fewer extension bars can be used when working in confined areas. Female end 27 includes a faceted outer surface 28 with flat sides and chamfered corners. The width of female end 27 is greater than the diameter of a cylindrical shaft 29 of extension bar 12, so that extension bar 12 is prevented by faceted outer surface 28 from rolling away, even when placed on a slanted surface which is contained in a plane. Male end 24 and female end 27 preferably have four sides each. The sides of male end 24 are preferably aligned with the sides of female end 27 and at least one of the flat facets of the female end at least one flat facet of the male end simultaneously contact the slanted surface, in order to prevent extension bar 12 from rolling. Faceted outer surface 28 also enables female end 27 to be gripped by a conventional open or box wrench for increased turning power when extension bar 12 is used as an extension bar instead of as a handle.

Wrench head 10 includes a tubular member 30 with a longitudinal slot 31, and a C-shaped internal brace 32 arranged at an intermediate position in tubular member 30. Tubular member 30 is divided by brace 32 into a pair of sockets 33 and 34 at opposite ends thereof. Brace 32 also prevents the sockets from spreading. Socket 33 comprises a five-point, six-sided socket, and socket 34 comprises a ten-point, twenty-sided socket for gripping all six sides of a nut 35 or a bolt 36, so as to prevent slipping or stripping the nut or bolt. Slot 31 is narrower than the internal width of sockets 33 and 34. The top and bottom surfaces of brace 32 are concave for conforming to the conventionally convex top and bottom surfaces of nuts and bolts, and for providing fillets 56 (one shown) between the walls of the sockets and brace 32 for increased strength. Wrench head 10 can be positioned on nut 35 or bolt 36 by slipping one of the sockets axially thereon. If space is limited, wrench head 10 can also be positioned on nut 35 by slipping a shaft 37 of bolt 36 through slot 31, and sliding a socket onto nut 35. The wrench head is provided in a variety of sizes for mating with nuts and bolts of different sizes.

FIG. 2

Figure 2:
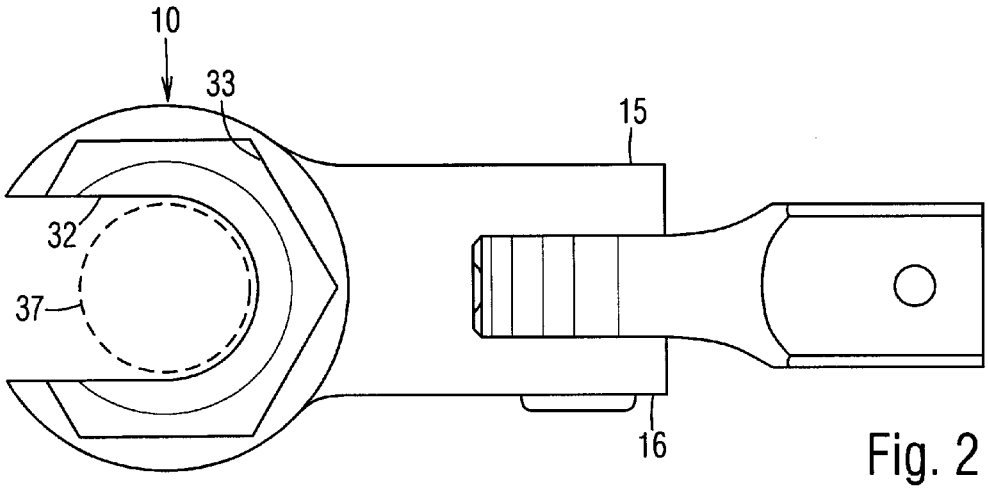
FIG. 2 is a plan view of one side of a wrench head of the wrench apparatus.

One side of wrench head 10 is shown in a plan view in FIG. 2. The opening of C-shaped brace 32 is slightly larger than the diameter of shaft 37 of the bolt, so that the threads thereon will not be damaged.

FIG. 3

Figure 3:
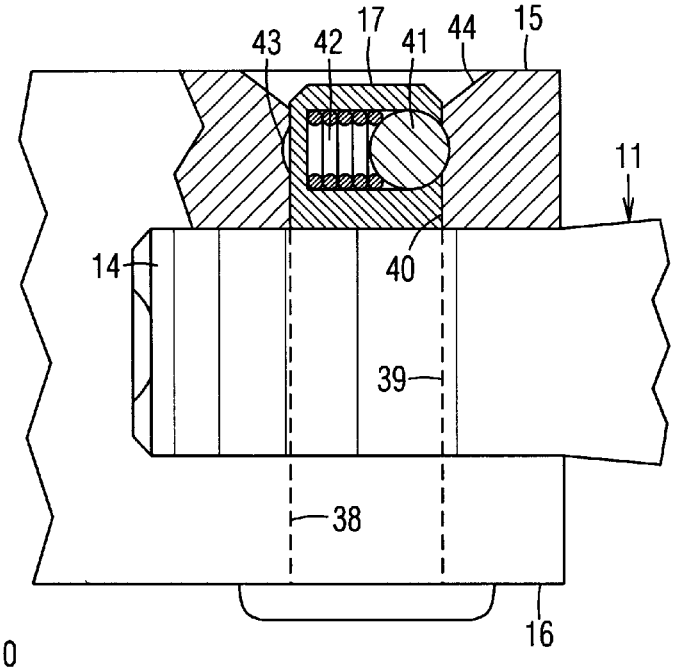
FIG. 3 is an enlarged partial broken view of a hinge pin of the wrench apparatus.

Ears 15 and 16 are shown in an enlarged partial broken view in FIG. 3. Pin 17 is extended through a hole 38 on ear 16, a hole 39 on semi-cylindrical end 14 of swivel adapter 11, and a hole 40 on ear 15. A ball 41 protruding slightly from the side of one end of pin 17 is loaded by a compression spring 42 against an annular detent 43 similar to annular detent 22 (FIG. 1) on ratchet head 13 (FIG. 1), so that pin 17 is secured in position. A tapered outer end 44 of hole 40 enables pin 17 to be pushed out easily for separating wrench head 10 from swivel adapter 11, so that swivel adapter 11 can be attached to another wrench head or the ratchet head. The distal end of pin 17 is slightly tapered for easily passing through holes 38–40, and is slightly recessed from the outer surface of ear 15 so as to prevent itself from being pushed out of position inadvertently. Ball 41 is staked in position, so that it does not fall out when pin 17 is removed.

FIG. 4

Figure 4:
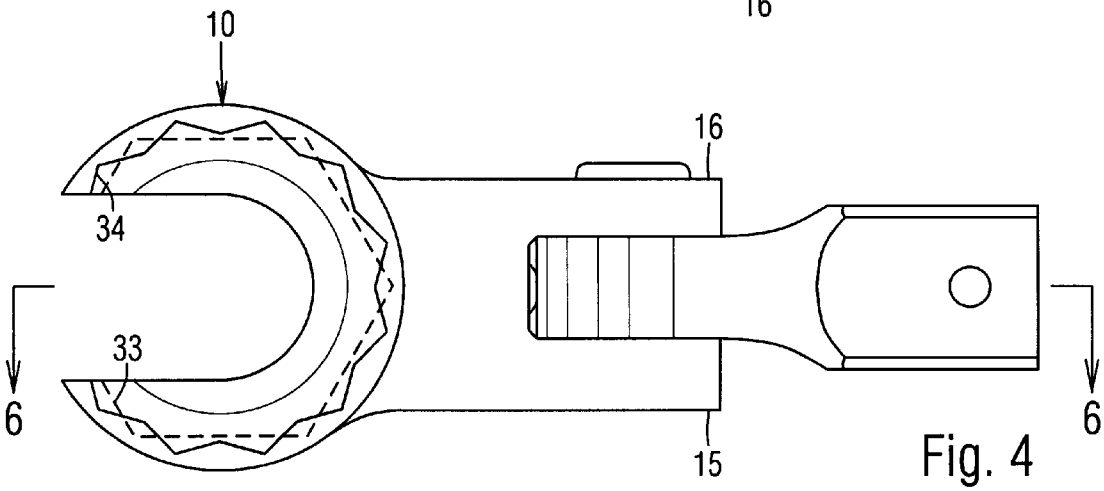
FIG. 4 is a plan view of an opposite side of the wrench head.

An opposite side of wrench head 10 is shown in a plan view in FIG. 4. Five-point socket 33 has five outer corners for allowing wrench head 10 to be repositioned on a nut or bolt in sixty-degree increments for use in relatively open spaces. Ten-point socket 34, i.e., a socket with ten outer corners, allows wrench head 10 to be repositioned on a nut or bolt in thirty degree increments for working in tight spaces. Ten-point socket 34 is radially offset relative to five-point socket 33 by fifteen degrees to enable wrench head 10 to be repositioned in fifteen degree increments by flipping it over to switch between the two sockets.

FIG. 5

Figure 5:
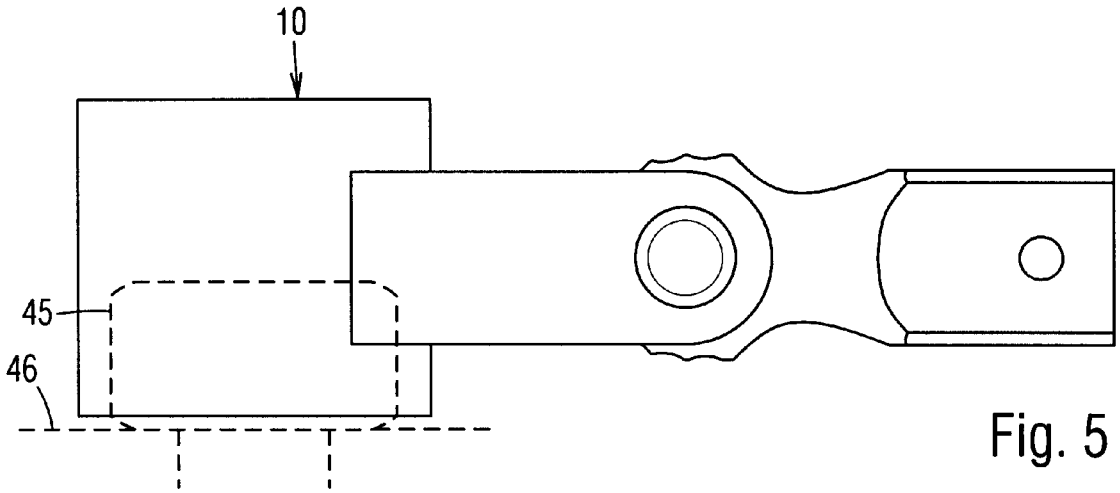
FIG. 5 is a side view of the wrench head positioned on a bolt.

Wrench head 10 is shown in a side view in FIG. 5. The depth of the sockets are preferably shorter than the thickness of a standard nut head 45, so that if nut head 45 is positioned against a painted surface 46, the end of wrench head 10 is spaced from surface 46 to avoid scratching it.

FIG. 6

Figure 6:
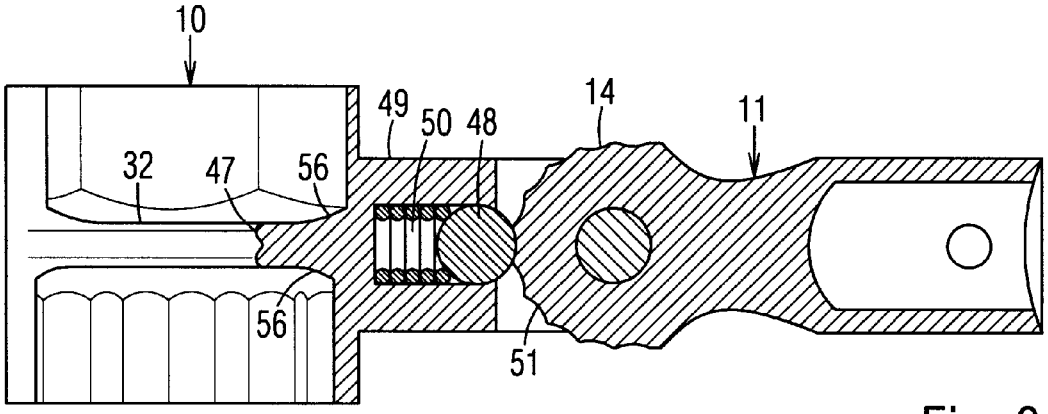
FIG. 6 is a side sectional view of the wrench head, taken along line 6—6 in FIG. 4.

As shown in the side sectional view in FIG. 6, raised ribs 47 are arranged along the edge of brace 32 for additional strength. A ball 48 is positioned in an orthogonal shank 49 of wrench head 10, and is loaded by a compression spring 50 against detents 51 on semi-circular end 14 of swivel adapter 11, which can be made in any size, e.g., ¼", ⅜", ½", etc. Swivel adapter 11, and thus also the handle (not shown), can be rotated up to 90 degrees to each side of wrench head 10 for flexibility in confined areas. When swivel adapter 11 is positioned at a right angle to wrench head 10, the handle can be cranked around in a parallel manner to rotate wrench head 10 very quickly. Spring-loaded ball 48 is also provided in ratchet head 13 (FIG. 1). Ball 48 is staked in position, so that it does not fall out when swivel adapter 11 is removed.

The wrench apparatus is used in a conventional manner with the following exceptions. To tighten or loosen a nut or bolt in an unconfined space, e.g., as in FIG. 5, five-point socket 33 is used for faster operation. Since there is ample space, this socket can be repositioned on any of its sixty degree increments. If the nut or bolt is in a confined space where there is not enough room to reposition the socket and its operating handle in sixty degree increments, ten-point socket 34 is used, so that it can be repositioned in thirty degree increments. However, in extremely confined spaces, even this may not be enough, so socket 33 and 34 can be used alternately, thereby providing a finer fifteen degree increment.

FIGS. 7–8

Figure 7:
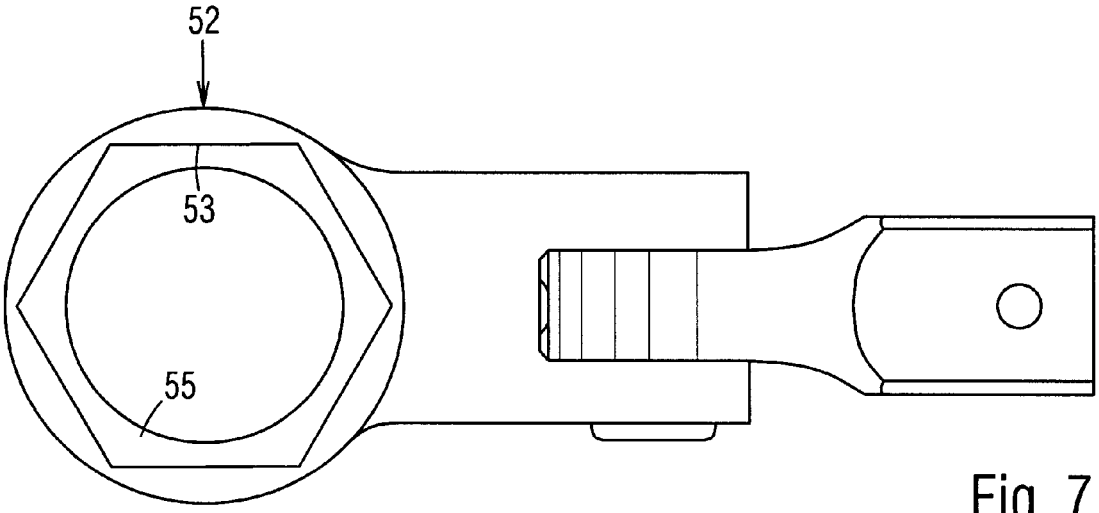
FIG. 7 is a plan view of one side of an alternative wrench head.
Figure 8:
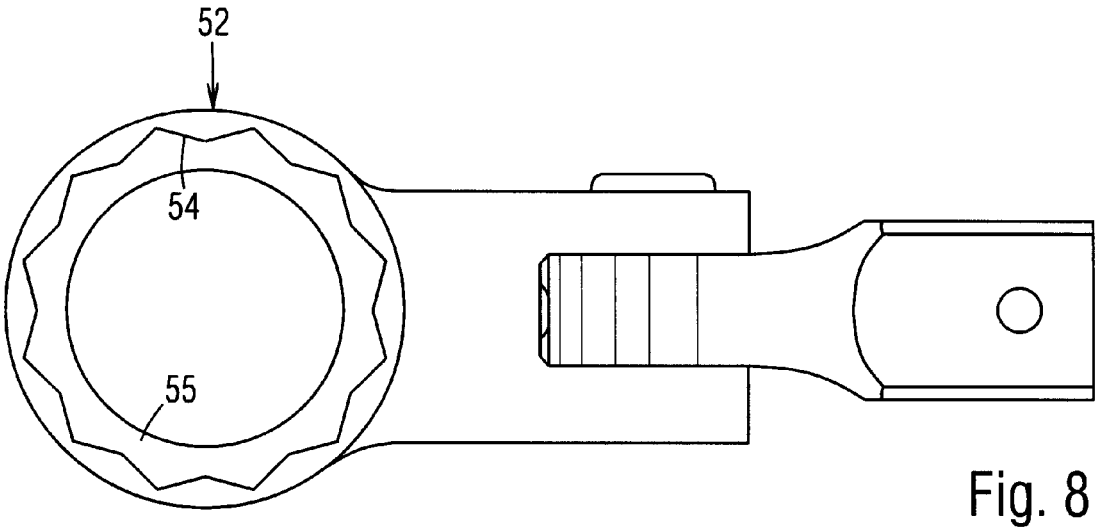
FIG. 8 is a plan view of an opposite side of the alternative wrench head.

Opposite sides of an alternative wrench head 52 is shown in the plan views in FIGS. 7 and 8. Wrench head 52 includes sockets 53 and 54 with fully enclosed sides. Sockets 53 and 54 are six-point and twelve-point sockets, respectively, and are also offset fifteen degrees with respect to each other. Sockets 53 and 54 are divided by an annular brace 55 with an open center for allowing a bolt or shaft (not shown) to pass through.

SUMMARY AND SCOPE

Accordingly, I have provided a wrench head that securely grips all six sides of a nut or bolt. It includes both five-point and ten-point sockets, and six-point and twelve point sockets in an alternative embodiment. It can be repositioned in finer increments for maximizing rotation in tight spaces. It includes a C-shaped internal brace for strength. It is interchangeable with different size wrench heads for reduced bulk and weight. It includes a combination handle and extension bar which tends to stay in position even when placed on a slanted surface. It includes a swivel adapter for connecting the wrench heads to the handle, so that the handle can be positioned at different angles relative to the wrench head. The swivel adapter can be interchangeably connected to different wrench heads and a ratchet head.

Although the above descriptions are specific, they should not be considered as limitations on the scope of the invention, but only as examples of the embodiments. Many substitutes and variations are possible within the teachings of the invention. For example, wrench head 10 can be provided in a variety of sizes. Both sockets on wrench head 10 can have the same number of sides and points. The sockets can be provided with more or fewer points for matching special nuts and bolts. The number of points on the finer socket need not be twice that of the other socket. Ears 15 and 16 can be provided on other types of tool heads for attaching to swivel adapter 11. Sockets 33, 34, 53, and 54 can be of different sizes. Extension bar 12 can be of any length, and shaft 29 can be a square bar instead of a cylinder to prevent rolling. Ears 15 and 16 may be provided on a handle, and semi-circular end 14 may be provided on a tool head. Pin 17 may be non-removably attached to ears 15 and 16, and ball 41 and spring 42 may be eliminated. Additional detent holes may be arranged on other sides of female end 27. Female end 28 of extension bar 12 can have more or fewer facets, e.g., it may have six facets for being turned by conventional box or open end wrenches. The thickness of the parts may be varied as necessary for strength, and to meet or exceed federal requirements. The ratchet may be eliminated. Therefore, the scope of the invention should be determined by the appended claims and their legal equivalents, not by the examples given.

I claim:

1. An extension bar for a tool, comprising:

an elongated cylindrical shaft having a male end and a female end, said male end for connecting to a female end of a second extension bar;

a hole extending axially into said female end for receiving a male end of a third extension bar, and the width of the female end being greater than the diameter of the shaft to define flat facets; and the male end having flat facets aligned with the flat facets of the female end whereby the flat facets of the female and male ends cooperate to prevent the extension bar from rolling when placed on a slanted surface contained in a plane, and whereby at least one flat facet of the female end and at least one flat facet of the male end simultaneously contact said slanted surface.

* * * * *